US006048416A

United States Patent [19]

Hauser et al.

[11] Patent Number: 6,048,416

[45] Date of Patent: Apr. 11, 2000

[54] STEEL, STEEL WIRE, AND PROCESS FOR FORMING DRAWN WIRE OF STEEL

[75] Inventors: Jean-Michel Hauser, Ugine; Joël Marandel, Varennes Vauzelles, both of France

[73] Assignees: Ugine-Savoie Imphy, Ugine; Sprint Metal - Societe de Production Internationale de Trefiles, Puteaux, both of France

[21] Appl. No.: 09/301,572

[22] Filed: Apr. 29, 1999

[30] Foreign Application Priority Data

Apr. 29, 1998 [FR] France ..... 98 05356

[51] Int. Cl.[7] ..... C21D 11/00

[52] U.S. Cl. ..... 148/500; 148/506; 148/578; 148/597; 148/598; 148/599; 148/648; 427/436; 428/656; 428/677

[58] Field of Search ..... 428/606, 607, 428/615, 655, 656, 668, 677, 923; 148/500, 503, 504, 506, 597, 598, 599, 226, 578, 648; 420/45, 49, 57, 58, 60, 61, 91, 97, 119, 120; 427/436

[56] References Cited

U.S. PATENT DOCUMENTS 3,819,399 6/1974 Campbell et al. ..... 427/388.3

FOREIGN PATENT DOCUMENTS 0 474 530 3/1992 European Pat. Off. .
0 648 891 4/1995 European Pat. Off. .
2 096 405 2/1972 France .
2 338 282 2/1974 Germany .
3-61322 3/1991 Japan .
WO 96/11812 4/1996 WIPO .

OTHER PUBLICATIONS

Patent Abstracts of Japan; Takeuchi Hidemaro; vol. 15, No. 211; May 29, 1991 & JP 03 061322; Mar. 18, 1991.

Patent Abstracts of Japan; Hagita Heiji; vol. 18, No. 052; Jan. 27, 1994 & JP 05 271771; Oct. 19, 1993.

*Primary Examiner*—Deborah Jones
*Assistant Examiner*—Robert R. Koehler
*Attorney, Agent, or Firm*—Oblon, Spivak, McClelland, Maier & Neustadt, P.C.

[57] ABSTRACT

Steel, steel wire, and a process for forming a drawn wire, especially tire-reinforcing wire of diameter smaller than 0.4 mm, by drawing a steel of the following composition by weight: 0.005%≦carbon≦0.050%; 0.005%≦nitrogen≦0.050%; 0.1%≦silicon≦2.0%; 0.1%≦manganese≦5%; 5%≦nickel≦12%; 10%≦chromium≦20%; 0.01%≦copper≦4%; 0.01%≦molybdenum≦3%, the base wire being subjected to:

drawing to a cumulative deformation ratio ε of larger than 2 and smaller than 4, an intermediate annealing treatment at above 700° C.

final drawing to a cumulative deformation ratio ε of smaller than 4.5 and larger than 3.

7 Claims, 2 Drawing Sheets

STEEL, STEEL WIRE, AND PROCESS FOR FORMING DRAWN WIRE OF STEEL

FIELD OF THE INVENTION

The present invention relates to a special steel, drawn steel wire, and a process for forming a drawn wire, especially tire-reinforcing wire of diameter smaller than 0.3 mm, by drawing a base machine wire of diameter larger than 5 mm or a pre-drawn base wire. The steel and steel wire are preferably stainless steel.

DISCUSSION OF THE BACKGROUND

Metal wires for reinforcing tire elastomers and suitable for use in the field of making parts exposed to fatigue must have a small diameter, in general between 0.1 mm and 0.4 mm, and high-performance mechanical characteristics. The tensile strength can be higher than 2200 MPa, the residual ductility, as measured by the reduction of area in tension, torsion or by wrap-around test must be non-zero, the fatigue endurance limit under rotational or alternating bending stress must be greater than 1000 MPa.

These characteristics are necessary to withstand the static or alternating forces to which the wire is subjected in the assemblies incorporated in tires.

In addition, drawing of the stainless-steel wire to a diameter of between 0.1 and 0.4 mm must be possible under industrial conditions, or in other words with the lowest possible incidence of breaking.

French Patent Application 93-12528 relates to the use of a stainless-steel wire of diameter of between 0.05 mm and 0.5 mm with tensile strength Rm higher than 2000 MPa. The steel of which the wire is made contains in its composition at least 50% martensite obtained by drawing to a reduction ratio of larger than 2.11 with intermediate annealing treatments, the total nickel plus chromium content being between 20% and 35%.

Patent No. 97-01858 relates to the forming of an austenitic stainless-steel wire in the state of work-hardened drawn wire containing a certain proportion of martensite formed during drawing, the drawing being performed without annealing, with a cumulative reduction ratio of greater than 6.

Cumulative deformation by drawing $\epsilon$ is understood as the value of the Naperian logarithm of the ratio of the initial and final cross sections ($\epsilon$=log [So/Sf]).

The described process specifies compositions which are particularly stable with respect to the martensite produced by work hardening, thus permitting tensile strengths of higher than 2200 MPa to be achieved when the cumulative deformation is extremely high and above 6.

Tire reinforcements are generally made by stranding wires of diameter between 0.1 mm and 0.30 mm. In the case of stainless steels, a tensile strength of 2200 MPa is sufficient in view of the fact that the behavior of the steel in service is not degraded or is degraded only slightly by the moist environment.

Higher tensile strengths may be of industrial interest, but difficulties are encountered in forming wires with very high-performance mechanical strength characteristics by drawing, because they become break-sensitive, in particular due to an excess of martensite.

It may be useful to propose, to the manufacturers of tire reinforcements, steel wires capable of being formed on their equipment, taking into account the physical or chemical treatment operations specific thereto.

OBJECTS OF THE INVENTION

One object of the invention is to form a drawn wire, especially a tire-reinforcing wire of diameter smaller than 0.4 mm, by drawing either a base machine wire of diameter larger than or equal to 5 mm or a pre-drawn base wire (together referred to herein as a wire) of given steel composition, having a mechanical characteristic of tensile strength higher than 2200 MPa and preferably higher than 2400 MPa without brittleness character, or in other words having non-zero reduction of area in tension. The steel useful in this process, and the product wire, and also objects.

DETAILED DESCRIPTION OF THE INVENTION

The invention process for forming a drawn wire, especially tire-reinforcing wire of diameter smaller than 0.4 mm, comprises drawing a base machine wire of diameter larger than 5 mm or a pre-drawn base wire (a wire) of a steel comprising iron and the following composition by weight:

$0.005\% \leqq \text{carbon} \leqq 0.050\%$ $0.005\% \leqq \text{nitrogen} \leqq 0.050\%$.

the carbon and nitrogen preferably satisfying the relationship $C\,\% + N\,\% \leqq 60 \times 10^{-3}\%$ $0.1\% \leqq \text{silicon} \leqq 2.0\%$, $0.1\% \leqq \text{manganese} \leqq 5\%$, $5\% \leqq \text{nickel} \leqq 12\%$.

$10\% \leqq \text{chromium} \leqq 20\%$, $0.01\% \leqq \text{copper} \leqq 4\%$, $0.01\% \leqq \text{molybdenum} \leqq 3\%$, $0.0001\% \leqq \text{sulfur} \leqq 0.030\%$, $0.005\% \leqq \text{phosphorus} \leqq 0.10\%$, impurities inherent to manufacture having a content of less than 0.5% for each individual element and of less than 1% in total, the composition satisfying the following relationship:

$JM = 551 - 462 \times (C\,\% + N\,\%) - 9.2 \times Si\,\% - 20 \times Mn\,\% - 13.7 \times Cr\,\% - 29 \times (Ni\,\% + Cu\,\%) - 18.5 \times Mo\,\%$, with $-55 < JM < -30$, Preferably, the base wire is subjected to:

pre-drawing to a cumulative deformation ratio $\epsilon$ of larger than 2 and smaller than 4, to obtain a wire of diameter between 2 mm and 0.7 mm, an intermediate annealing treatment at above 700° C., permitting reconstitution of a mainly austenitic, soft-annealed structure, if necessary, conditioning before final reduction, final drawing to a cumulative deformation ratio $\epsilon$ of smaller than 4.5 and larger than 3, to obtain a wire of diameter between 0.1 mm and 0.4 mm, the wire being maintained at a temperature below 600° C. between the two drawing operations, without annealing between the drawing passes.

The preferred characteristics of the invention include:

the composition satisfies the following relationship:

$JM = 551 - 462 \times (C\,\% + N\,\%) - 9.2 \times Si\,\% - 20 \times Mn\,\% - 13.7 \times Cr\,\% - 29 \times (Ni\,\% + Cu\,\%) - 18.5 \times Mo\,\%$, with $-55 < JM < -30$, the deformation ratio in drawing being related to JM by the relationship: $-9.23\,\epsilon - 17 < JM < -9.23\,\epsilon + 3$.

the composition includes from 3% to 4% of copper.

the conditioning before final drawing is additionally an operation of coating the annealed wire by a metal or a metal alloy chosen from among copper, brass, zinc.

the intermediate annealing treatment is performed at a temperature between 700° C. and 1350° C. in a time adapted to the temperature and to the heating method, the conditioning before final drawing additionally comprises a diffusion treatment at below 700° C. of the deposits of Cu, Zn or brass on the annealed wire.

The invention also relates to a steel wire obtained by this process, including a tire-reinforcing wire of diameter smaller than 0.4 mm obtained by drawing a base machine wire of diameter larger than 5 mm or a pre-drawn base wire (a wire) comprising iron and the following composition by weight:

0.005%≦carbon≦0.050%

0.005%≦nitrogen≦0.050%, the carbon and nitrogen satisfying the relationship C %+N %≦$60\times10^{-3}$%

0.1%≦silicon≦2.0%, 0.1%≦manganese≦5%

5%≦nickel≦12%,

10%≦chromium≦20%, 0.01%≦copper≦4%, 0.01%≦molybdenum≦3%, 0.0001%≦sulfur≦0.030%, 0.005%≦phosphorus≦0.10%, impurities inherent to manufacture having a content of less than 0.5% for each individual element and of less than 1% in total;

the wire having been subjected during forming thereof to annealing, followed if necessary before final drawing by conditioning comprising an operation of coating by a metal or a metal alloy chosen from among copper, brass, zinc, possibly followed by a diffusion treatment.

BRIEF DESCRIPTION OF THE DRAWINGS

The invention will be clearly understood from the description hereinafter and the attached figures, all given by way of non-limitative example.

Figure 1:
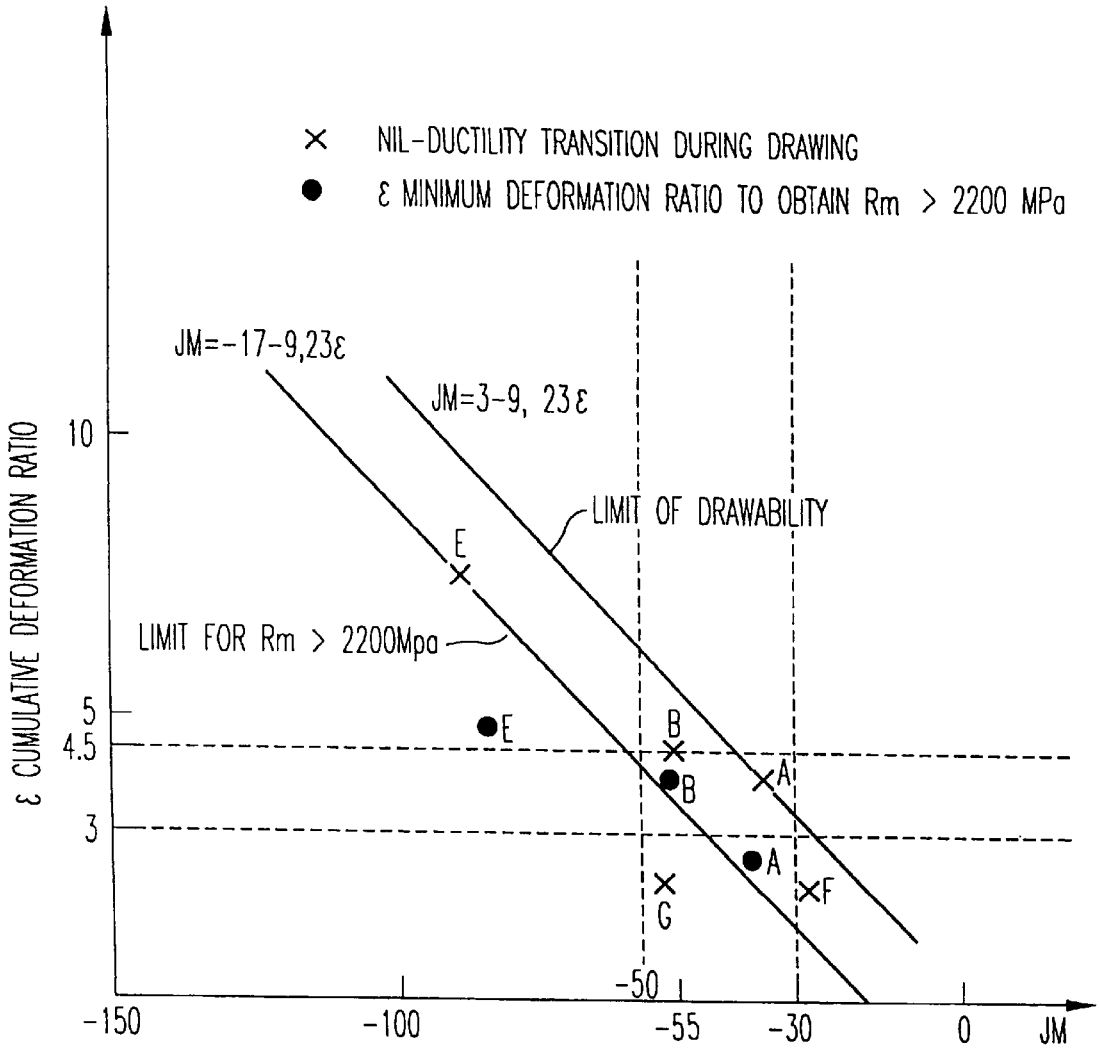
FIG. 1 shows the maximum cumulative deformation ratio ϵ which can be reached by industrial drawing between the two drawing operations as a function of the index JM defined by the relationship satisfying the composition.
Figure 2:
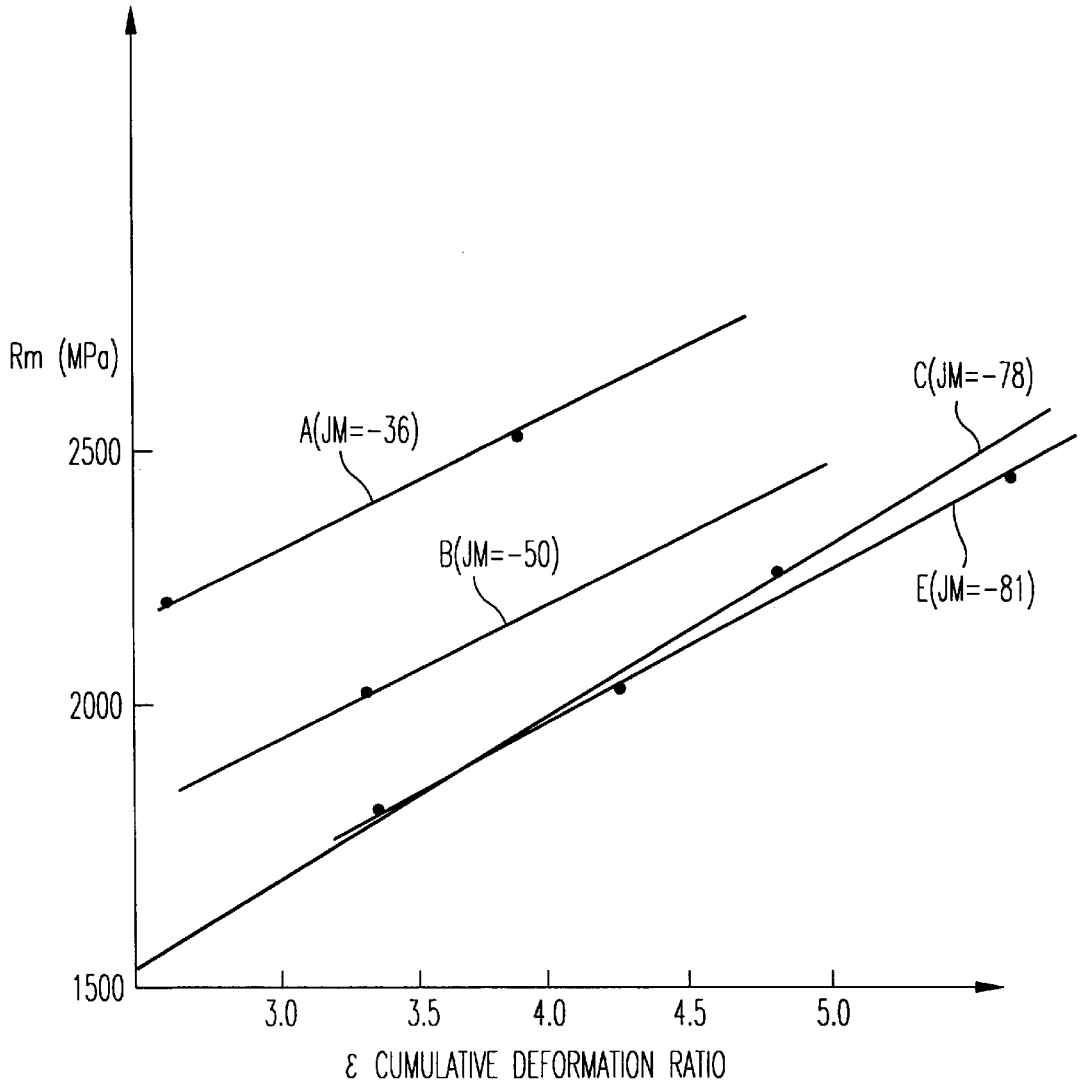
FIG. 2 shows, as a function of cumulative deformation ratio ϵ, the evolution of breaking load in the process according to the invention (steel A and B), compared with that of reference steels not part of the invention.

The drawing of a reinforcing stainless-steel wire whose diameter varies between 0.1 and 0.4 mm must allow durability during service from the viewpoint of fatigue endurance in bending or in tension or in torsion as well as resistance to a moist environment or to combined loading: moist environment and fatigue and wire-to-wire friction.

The fine wire is made by drawing starting with a machine wire or a pre-drawn steel wire. By virtue of the composition of the steel, the final drawn wire after drawing has improved properties of tensile strength and sufficient residual ductility to be assembled in the form, for example, of belts or cables.

According to the invention, drawing is performed with a stainless steel of general composition by weight A and B presented in Table 1, where steels C, E, F, G are listed for reference.

TABLE 1

| Steel | C | N | Si | Mn | Cr | Ni | Cu | Mo | S | P | JM |
|---|---|---|---|---|---|---|---|---|---|---|---|
| A | 0.023 | 0.032 | 0.38 | 0.54 | 18.2 | 10.0 | 0.36 | 0.23 | 0.0090 | 0.023 | −36 |
| B | 0.024 | 0.024 | 0.47 | 1.24 | 18.3 | 9.7 | 0.31 | 0.39 | 0.0011 | 0.025 | −50 |
| C | 0.011 | 0.027 | 0.40 | 1.83 | 17.2 | 8.1 | 3.24 | 0.36 | 0.0040 | 0.025 | −78 |
| E | 0.011 | 0.016 | 0.35 | 0.54 | 17.1 | 9.5 | 3.16 | 0.19 | 0.0020 | 0.027 | −81 |
| F | 0.085 | 0.038 | 0.85 | 1.05 | 17.5 | 8.2 | 0.38 | 0.21 | 0.0020 | 0.023 | −27 |
| G | 0.082 | 0.045 | 0.67 | 0.78 | 18.5 | 8.8 | 0.34 | 0.20 | 0.0030 | 0.025 | −52 |

The invention makes it possible to define an austenitic stainless steel capable of being drawn without annealing from a machine wire of diameter larger than 5 mm to a diameter between 0.7 mm and 2 mm and thereafter of being annealed at this intermediate diameter and if necessary coated, for example with brass, and finally of being drawn once again without annealing, between the drawing passes, to a final diameter of between 0.4 and 0.1 mm. In this way there is obtained a mechanical characteristic of tensile strength Rm greater than 2200 MPa and preferably greater than 2400 MPa without a brittle character.

The composition according to the invention preferably satisfies a relationship JM in a limited interval determined such that, for specific cumulative reduction ratios during final drawing of between ϵ higher than 3 (or in other words from 1.6 mm to less than 0.357 mm; from 1.2 mm to less than 0.268 mm; from 0.8 mm to less than 0.179 mm) and ϵ lower than 4.5 (or in other words from 1.6 mm to more than 0.169 mm; from 1.2 mm to more than 0.126 mm; from 0.8 mm to more than 0.0084 mm), direct drawing of wire of final diameter between 0.1 mm and 0.4 mm is possible without excessive brittleness, with a tensile strength higher than 2200 Mpa.

Direct drawing is understood as a drawing operation comprising a succession of drawing passes, for each of which the initial temperature of the wire is between room temperature and 200° C., and at no time is the wire heated to a temperature above 600° C.

Table 1 presents, for comparison, steel compositions which do not satisfy the characteristics of the invention (steels C, E, F, G).

Table 2 presents some examples of drawing of steels according to the invention and not part of the invention.

TABLE 2

| Steel | Initial diameter (mm) | Final diameter (mm) | Cumulative ϵ | Rm MPa | Martensite % | Drawing |
|---|---|---|---|---|---|---|
| A | 4.36 | 1.19 | 2.60 | 2214 | 53 | correct |
| | 4.36 | 0.68 | 3.72 | 2500 | 69 | breaks |
| B | 1.0 | 0.18 | 3.43 | 2064 | — | correct |
| | 5.67 | 1.0 | 3.47 | 1828 | 16 | correct |
| C | 5.56 | 0.59 | 4.49 | 2165 | 69 | correct |
| | 5.56 | 0.55 | 4.63 | 2211 | 72 | — |
| | 5.56 | 0.25 | 6.24 | 2666 | 87 | breaks |
| E | 5.6 | 0.672 | 4.24 | 2069 | 62 | correct |

TABLE 2-continued

| Steel | Initial diameter (mm) | Final diameter (mm) | Cumulative ϵ | Rm MPa | Martensite % | Drawing |
|---|---|---|---|---|---|---|
| | 5.6 | 0.355 | 5.62 | 2424 | 86 | correct |
| | 5.6 | 0.178 | 6.90 | 2644 | 90 | breaks |
| F | 55 | 1.8 | 2.14 | 1950 | 22 | some breaks |
| G | 1.95 | 0.7 | 2.10 | 2064 | 35 | some breaks |

With steels A and B according to the invention, it is possible to achieve drawing without excessive breaks during drawing and with a cumulative deformation of greater than 3, and to obtain wires having a tensile strength of higher than 2200 MPa with cumulative deformations smaller than 4.5.

With steel E, which is not part of the invention, and whose coefficient JM is below −55, tensile strengths greater than 2200 MPa can be obtained only with a cumulative deformation larger than 4.6.

With steel C, which is not part of the invention, and whose coefficient JM is below −55, tensile strengths greater than 2200 MPa cannot be obtained with a cumulative deformation smaller than 4.5.

With steel F, which has a high carbon content and is not part of the invention, brittleness is developed during drawing to cumulative deformations of 3, and a ϵ larger than 3 cannot be obtained.

With steel G, which has a high carbon content and is not part of the invention, the result is the same, even though the index JM is between −30 and −55.

Wire drawing is preferably performed on a multi-pass machine, the wire on the one hand being lubricated with soap or liquid lubricant, and on the other hand having a temperature controlled to between 20° C. and 180° C.

The wire can also be brass-coated between the two drawing operations. The brass layer improves the drawing capacity and the adhesion of the wire to the elastomers of tires.

From the metallurgical viewpoint, it is known that certain alloying elements included in the composition of the steels favor the development of the ferrite phase, whose metallographic structure is of body-centered cubic type. These elements are known as alphagenic. They include chromium, molybdenum, silicon.

Other elements known as gammagenic favor the development of the austenite phase, whose metallographic structure is of face-centered cubic type. These elements include carbon, nitrogen, manganese, copper, nickel.

Carbon, nitrogen, chromium, nickel, manganese, silicon are common elements which permit an austenitic stainless steel to be obtained.

It has been noticed that the compositions which form an excessive quantity of martensite during drawing become brittle and break-sensitive during drawing. This quantity of martensite is a function of the total content of carbon plus nitrogen in the steel and is on the order of 70% for a total carbon plus nitrogen content of less than or equal to 0.060% and, for example, of 30% for a total carbon plus nitrogen content of about 0.100%.

According to the invention, the steel has a total carbon plus nitrogen content of less than or equal to 0.060%, and the drawing conditions satisfy the following relationship:

$$-55<JM<-30$$

It has also been noticed that the compositions having an index JM higher than the value determined hereinabove and a total carbon plus nitrogen content on the order of 0.040% become break-sensitive before drawing to the final diameter is achieved.

Similarly, the presence of an excessive quantity of silicon, or in other words a quantity larger than 2%, has the effect of embrittling the wire in the work-hardened state due to drawing in the presence of a large quantity of martensite.

The contents of manganese, chromium, sulfur are chosen in such proportions as to generate deformable sulfides of accurately determined composition.

Copper is added to the composition of the steel according to the invention because it stabilizes the austenite and as a result improves the cold-deformation properties. However, the copper content is limited to 4% to avoid difficulties in hot forming, because copper in a quantity higher than 4% substantially lowers the upper limit temperature for reheating the steel before rolling, to the point that local melting occurs thereabove.

According to one embodiment of the invention, the sulfur content must be below 0.030% in order to obtain sulfide inclusions of thickness not exceeding 5 μm in the rolled product.

Coarse inclusions of the oxide and sulfide type are generally considered to be detrimental with respect to the use properties in the field of drawing fine wire and in the field of fatigue strength, especially in bending and/or in torsion.

The composition of the stainless steel according to the invention, containing more than 5% of nickel, more than 0.01% of copper, more than 10% of chromium, a total carbon plus nitrogen content of less than 0.060%, an index JM of smaller than −30, can be drawn according to the process of the invention to the final diameter with reduced incidence of breakage, said wire still having mechanical characteristics which permit the use thereof in the field of tire reinforcement.

The index JM must be in the interval from −55 to −30. In fact, if JM is lower than −55, the quantity of martensite formed remains low and the tensile strength cannot achieve high values above 2200 MPa, even after final drawing with a cumulative deformation ϵ close to 4.5.

This observation justifies the limit of less than 20% on the chromium content and of less than 16% for the total copper plus nickel content.

The process applied to drawing of stainless steel according to the invention makes it possible to obtain a wire with excellent fatigue strength measured by rotational bending with an endurance stress of better than 1000 MPa at $2\times10^6$ cycles.

The wire obtained contains less than 50% of austenite or more than 50% of martensite. The steel used comprises slightly unstable austenite with a total carbon plus nitrogen content of less than 0.060%.

Starting with a steel of composition optimized for cold deformation and drawing of fine wire, the process according to the invention assures:

- a low tendency to formation of martensite, such that the quantity formed is sufficient to harden the steel but not sufficient to induce embrittlement of the wire after drawing,
- very progressive strengthening, such that the tensile strength can be between 2200 MPa and 3000 MPa for a drawn wire of 0.18 mm drawn from 5.5 mm with an intermediate annealing treatment, or for other drawn wires obtained with a cumulative reduction ratio of 3 to 4.5 after the last annealing treatment.

What is claimed is:

1. A process for forming a drawn wire, comprising drawing a wire of steel, said steel comprising iron and the following components in percent by weight:

$0.005\% \leqq \text{carbon} \leqq 0.050\%$ $0.005\% \leqq \text{nitrogen} \leqq 0.050\%$, $0.1\% \leqq \text{silicon} \leqq 2.0\%$, $0.1\% \leqq \text{manganese} \leqq 5\%$, $5\% \leqq \text{nickel} \leqq 12\%$, $10\% \leqq \text{chromium} \leqq 20\%$, $0.01\% \leqq \text{copper} \leqq 4\%$, $0.01\% \leqq \text{molybdenum} \leqq 3\%$ $0.0001\% \leqq \text{sulfur} \leqq 0.030\%$, $0.005\% \leqq \text{phosphorus} \leqq 0.10\%$, and impurities inherent to manufacture having a content of less than 0.5% for each individual impurity element and a content of less than 1% in total, the steel composition satisfying the following relationship:

$JM=551-462\times(C\ \%+N\ \%)-9.2\times Si\ \%-20\times Mn\ \%-13.7\times Cr\ \%-29\times(Ni\ \%+Cu\ \%)-18.5\times Mo\ \%$, with $-55 \leqq JM \leqq -30$, the wire being subjected to:

pre-drawing to a cumulative deformation ratio $\epsilon$ of larger than 2 and smaller than 4, to obtain a wire of diameter of between 2 mm and 0.7 mm, an intermediate annealing treatment at above 700° C., permitting reconstitution of a mainly austenitic, soft-annealed structure, optional conditioning before final reduction, final drawing to a cumulative deformation ratio $\epsilon$ of smaller than 4.5 and larger than 3, to obtain a drawn wire of diameter of between 0.1 mm and 0.4 mm.

the wire being maintained at a temperature below 600° C. between pre-drawing and final drawing operations, without annealing between the drawing operations.

2. A process according to claim 1, wherein the steel satisfies the following relationship:

$JM=551-462\times(C\ \%+N\ \%)-9.2\times Si\ \%-20\times Mn\ \%-13.7\times Cr\ \%-29\times(Ni\ \%+Cu\ \%)-18.5\times Mo\ \%$, with $-55<JM<-30$, the deformation ratio in drawing being related to JM by the relationship:

$-9.23\epsilon-17<JM<-9.23\epsilon+3$.

3. A process according to claim 1, wherein the steel includes from 3% to 4% of copper.

4. A process according to claim 1, comprising conditioning before final drawing, wherein said conditioning is an operation of coating by a metal or a metal alloy chosen from the group consisting of copper, brass, and zinc.

5. A process according to claim 1, wherein the intermediate annealing treatment is performed at a temperature of between 700° C. and 1350° C.

6. A process according to claim 1, comprising conditioning before final drawing, which conditioning comprises a diffusion treatment at below 700° C. of deposits of copper, zinc or brass on the annealed wire.

7. The process as claimed in claim 1, wherein the carbon and nitrogen satisfy the following relation:

$C\ \%+N\ \% \leqq 60\times10^{-3}\%$.

* * * * *